US006306016B1

(12) United States Patent
Steere, Jr. et al.

(10) Patent No.: US 6,306,016 B1
(45) Date of Patent: Oct. 23, 2001

(54) WAFER NOTCH POLISHING MACHINE AND METHOD OF POLISHING AN ORIENTATION NOTCH IN A WAFER

(75) Inventors: Robert E. Steere, Jr.; Robert E. Steere, III, both of Boonton, NJ (US)

(73) Assignee: TSK America, Inc., Oakland, NJ (US)

( * ) Notice: Subject to any disclaimer, the term of this patent is extended or adjusted under 35 U.S.C. 154(b) by 0 days.

(21) Appl. No.: 09/631,656

(22) Filed: Aug. 3, 2000

(51) Int. Cl.[7] ..... B24B 1/00
(52) U.S. Cl. ..... 451/44; 451/43; 451/168
(58) Field of Search ..... 451/44, 41, 42, 451/43, 168, 296, 11

(56) References Cited

U.S. PATENT DOCUMENTS 5,185,965 * 2/1993 Ozaki ..... 51/283 R
5,289,661 * 3/1994 Jones et al. ..... 51/283 E
5,445,554 * 8/1995 Hosokawa ..... 451/11
5,458,529 * 10/1995 Hasegawa et al. ..... 451/177
5,733,181 * 3/1998 Hasegawa et al. ..... 451/168

* cited by examiner

*Primary Examiner*—Timothy V. Eley
*Assistant Examiner*—Dung Van Nguyen
(74) *Attorney, Agent, or Firm*—Francis C. Hand; Carella, Byrne, Bain, Gilfillan, Cecchi, Stewart & Olstein

(57) ABSTRACT

The notch polishing machine employs a plurality of polishing tapes which can be sequentially introduced into the notch of a wafer to polish both sides of the notch, i.e. the top and bottom surfaces. Each tape is pulled off a supply reel and passed into a mounting block sized to fit into the wafer notch. Each block is also mounted to be oscillated to effect a polishing action. Also, all the blocks are mounted in common to be pivoted between a position angularly disposed relative to the top of the top of the wafer and a position angularly disposed relative to the bottom of the wafer.

23 Claims, 9 Drawing Sheets

WAFER NOTCH POLISHING MACHINE AND METHOD OF POLISHING AN ORIENTATION NOTCH IN A WAFER

This invention relates to a wafer notch polishing machine and method of polishing an orientation notch in a wafer.

As is known, various types of wafers, such silicon wafers, have been employed in the manufacture semi-conductor chips. Typically, the wafers have been obtained by the slicing of a solid cylindrical ingot into individual wafers. Once cut, the wafers are processed in various manners and particularly to provide a peripheral edge of a predetermined contour. Various type of grinding and polishing machines have also been employed for this purpose.

As is also known, ingots have been provided with a groove to serve for orientation of the crystalline structure of the ingot so that the wafers which are obtained have a notch in the periphery. This notch serves as a reference point for the further processing of the wafers into semi-conductor chips.

During the processing of a wafer into semi-conductor chips, small subsurface cracks or fractures on the peripheral edge of the wafer have been found to have a tendency of migrating into the wafer to such an extent that a significant portion of the wafer becomes unusable for the manufacture of the semi-conductor chips. Hence, the reason for polishing the peripheral edge of the wafer is to avoid such cracks or fractures. However, one of the problems attendant with the polishing of the peripheral edge of the wafer is the need to polish the notch. To date, the techniques which have been available have been cumbersome or not used at all.

Accordingly, it is an object of the invention to provide a relatively simple polishing machine for polishing a notch in a wafer.

It is another object of the invention to be able to polish the orientation notch of a silicon wafer in a simple economical manner.

It is another object of the invention to provide a wafer notch polishing machine that can be employed as a stand-alone unit or as a station in a wafering grinding and polishing machine.

Briefly, the invention provides a wafer notch polishing machine which employs a chuck for holding a wafer having a peripheral notch thereon, means for moving the chuck in two mutually perpendicular directions on a common plane, and a polishing unit for moving a polishing medium within the notch along an axis perpendicular to the common plane and angularly within a plane perpendicular to the common plane.

The polishing unit is constructed to move the polishing medium relative to the wafer so that the polishing medium is able to polish the peripheral edge of the wafer within the notch as well as both sides of the wafer within the notch. Depending upon the cross-sectional shape of the wafer within the notch, the polishing unit is programmed to follow the contour of the notch during the polishing operation. In particular, the polishing unit includes a means for oscillating the polishing medium during movement between the two angular positions relative to the wafer. The oscillation of the polishing medium effects a polishing of the exposed surfaces of the wafer within the notch.

In one embodiment, the polishing medium is in the form of a polishing tape mounted on a rounded nose surface of a resilient backing and , in particular, in the form of a length of polishing tape that is supplied to and around the nose surface of the backing by a suitable means so that fresh surfaces of the tape may be used for polishing. For example, this means includes a supply reel disposed on an axis parallel to the common plane of movement of the chuck for feeding the polishing tape to the backing and a take-up reel disposed on an axis parallel to the same plane for winding-up of the polishing tape from the backing. In addition, the rounded nose surface has a forward portion on a radius less than a radiused portion of the notch in the wafer.

In order to move the polishing medium within a notch of a wafer, the polishing unit has a means for pivoting the backing about an axis parallel to the common plane between a first position with the backing disposed angularly of one surface of the wafer and a second position with the backing disposed angularly of the opposite surface of the wafer.

The polishing unit may be constructed to have a plurality of polishing media disposed in spaced apart parallel relation. In this way, polishing media having different grades of grit may be employed from a course grade to a fine grade. To this end, the chuck on which the wafer is mounted is indexed to move laterally from one polishing medium to another in order to conduct a notch polishing operation.

These and other objects of the invention will become more apparent from the following detailed description taken in conjunction with the accompanying drawings wherein:

FIG. 1 illustrates a schematic view of a backing holding a polishing tape within a notch of a wafer in accordance with the invention;

FIG. 2 schematically illustrates one angular position of a polishing tape relative to an upper surface of a wafer during a polishing operation in accordance with the invention;

FIG. 3 schematically illustrates a view of a polishing tape held in a different angular position relative to a lower surface of the wafer in accordance with the invention;

FIG. 4 schematically illustrates a view of the polishing tape of FIG. 1 and a backing within the notch of a wafer during a polishing operation;

FIG. 5 schematically illustrates a plurality of backings for a plurality of polishing tapes for sequentially polishing a notch in a wafer;

Figure 1:
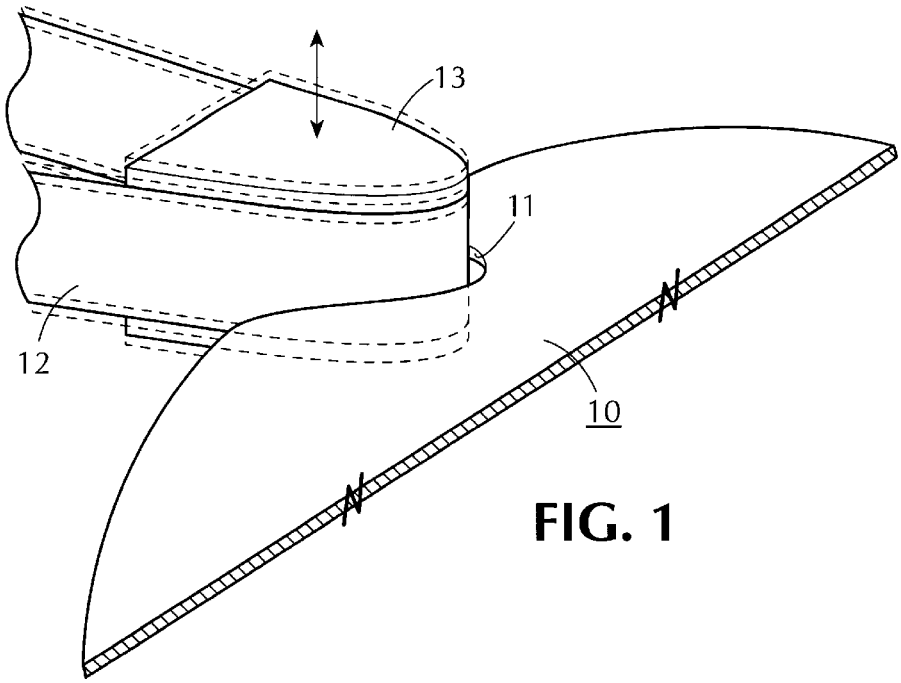
Figure 2:
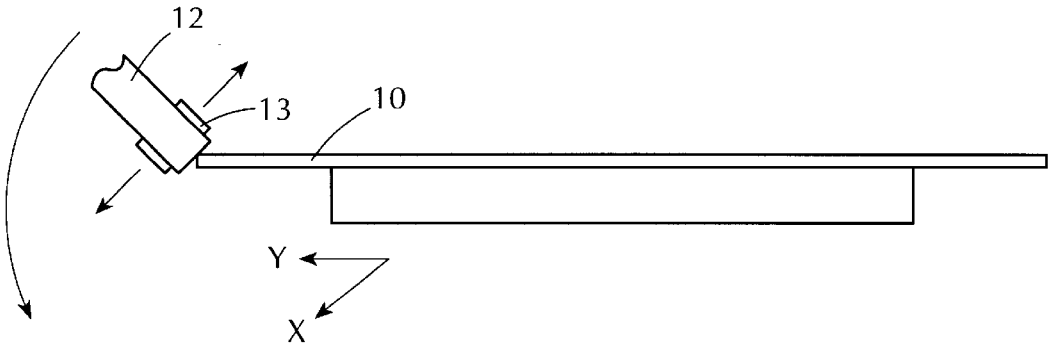
Figure 3:
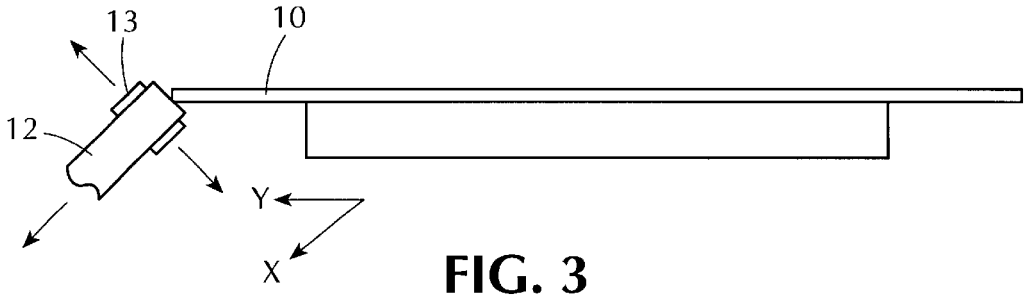

Referring to FIGS. 1 to 4, in accordance with the method of the invention, a wafer 10 which is provided with an orientation notch 11 is subjected to a polishing operation by means of a polishing medium in the form of a polishing tape 12 disposed about a resilient backing 13. During a polishing operation, the wafer 10 is held in a fixed plane, for example, a horizontal plane, as indicated in FIGS. 2 and 3, and is moved in two mutually perpendicular directions within the plane for reasons as explained below.

Figure 4:
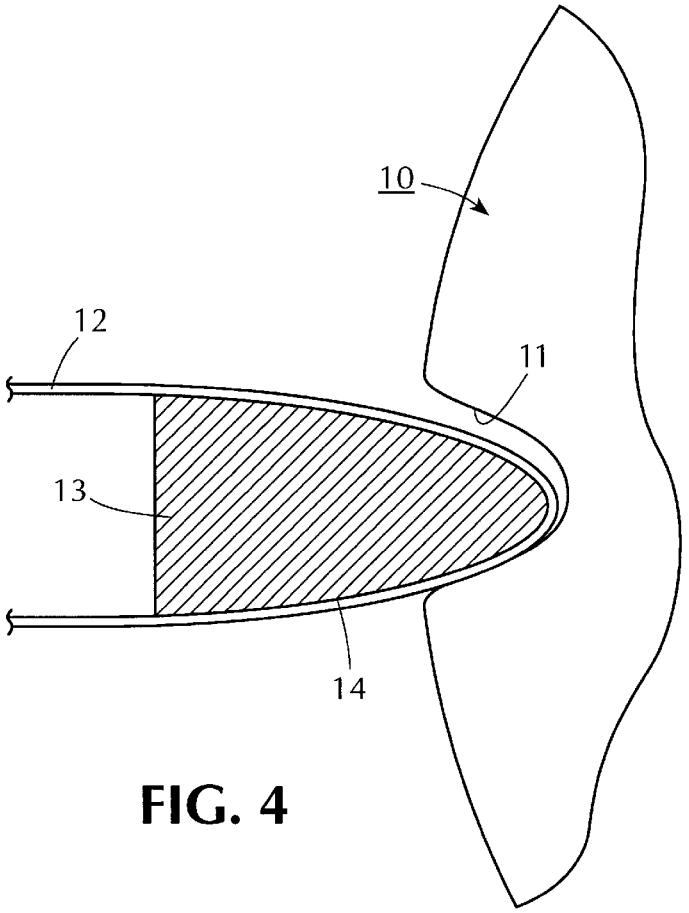

As illustrated in FIGS. 1 and 4, the polishing tape 12 is moved within the notch 11 of the wafer 10 along an axis perpendicular to the plane of the wafer 10 and angularly, as shown in FIGS. 2 and 3, within a plane perpendicular to the plane of the wafer 10. As also illustrated, the resilient backing 13 has a rounded nose surface 14 about which the tape 12 is mounted. In addition, this rounded nose surface 14 has a forward portion on a radius less than a radiused portion of the notch 11 in the wafer 10. Thus, during a polishing operation, the wafer 10 may be moved within the plane of the wafer in X and Y directions so that the polishing tape 12 is able to polish all the peripheral surface of the notch 11.

As indicated in FIGS. 2 and 3, the backing and polishing tape are pivoted about an axis parallel to the plane of the wafer 10 between a first position with the polishing tape disposed angularly of one surface of the wafer 10 and a second position with the polishing tape disposed angularly of the opposite surface of the wafer 10. In this way, not only is the peripheral surface of the notch 11 polished within a plane perpendicular to the plane of the wafer 10 but also any chamfered surfaces on the notch 11 may be polished.

During the polishing operation, the backing 13 is oscillated longitudinally thereof during pivoting between the various positions. In this way, a gentle polishing action is carried out on the exposed surfaces of the notch 11.

Figure 5:
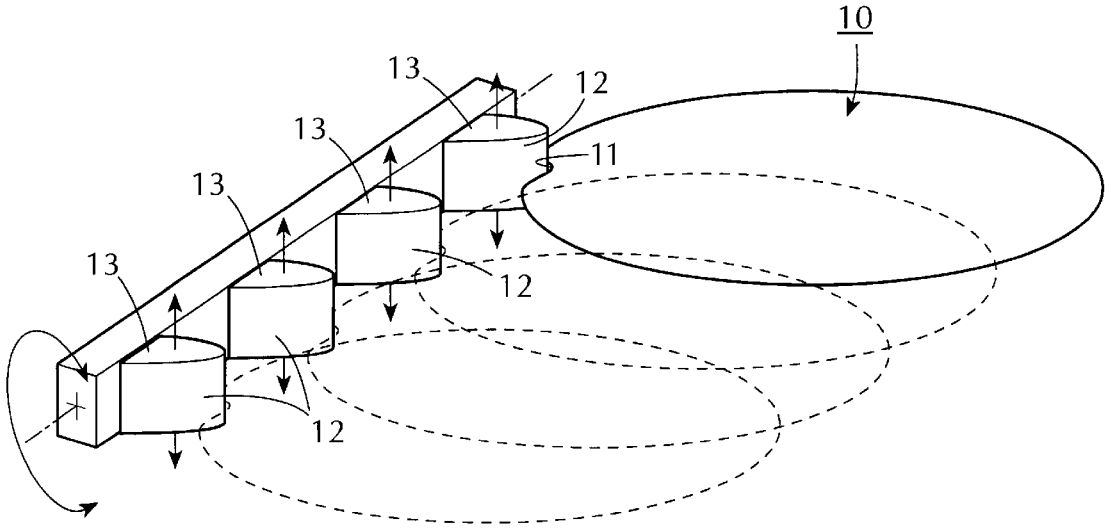

Referring to FIG. 5, wherein like characters indicate like parts as above, a plurality of polishing tapes 12 may be employed in the polishing operation with each having a different size of grit from coarse to fine. As indicated, the wafer 10 may be moved from polishing tape to polishing tape 12 in a sequential manner or may be moved to only some of the polishing tapes.

Figure 6:
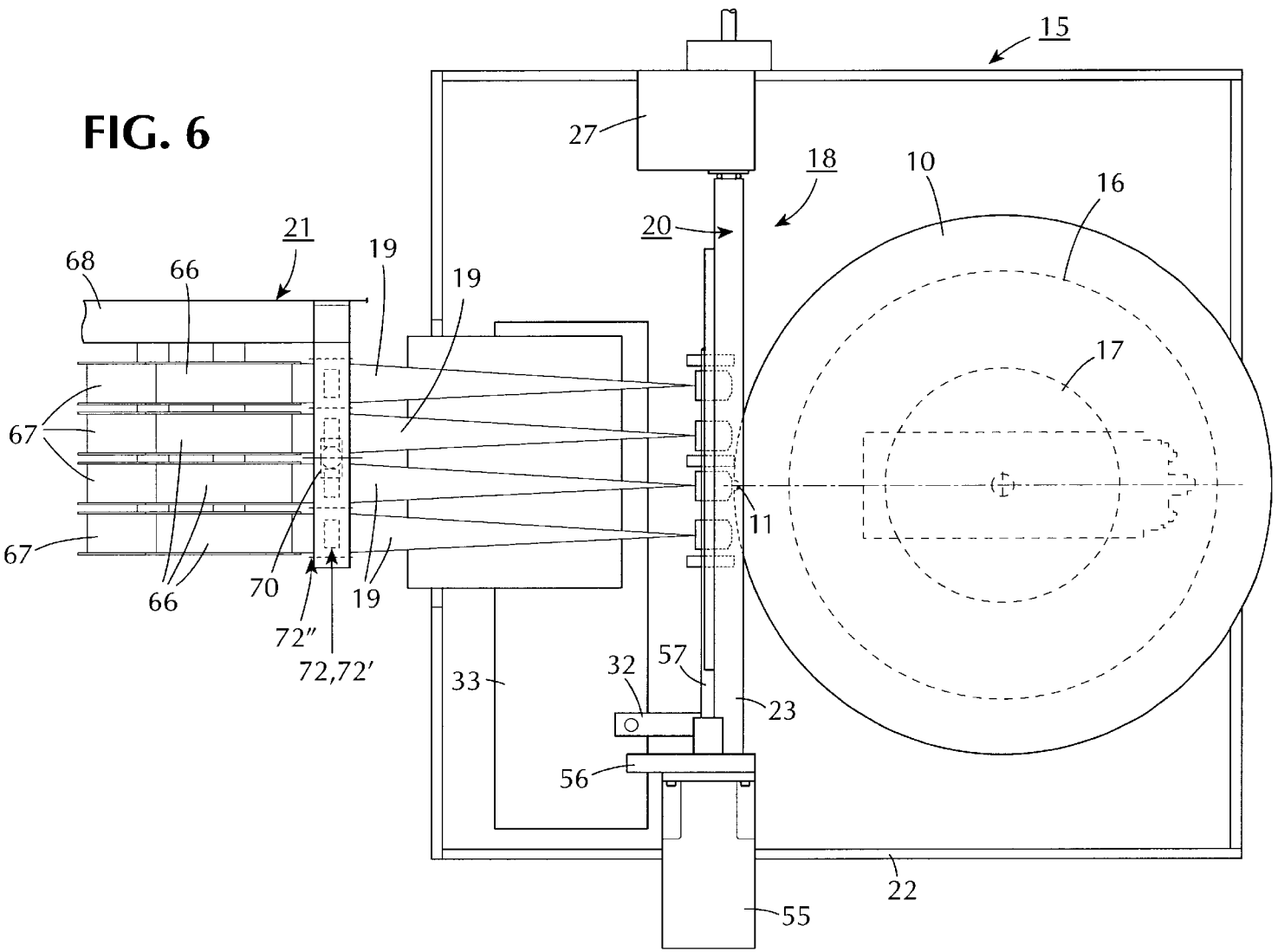
FIG. 6 illustrates a plan view of a wafer notch polishing machine employing four polishing tapes in accordance with the invention.

Referring to FIG. 6, the wafer notch polishing machine 15 is constructed as a stand-alone unit, or a unit which may be incorporated into an edge grinder or other processing equipment, such as that described in pending patent application U.S. Ser. No. 09/491,812, filed Jan. 28, 2000.

The polishing machine 15 includes a chuck 16 for holding a wafer 10 having a peripheral notch 11. For example, the chuck 16 is disposed so that the wafer 10 is mounted in a horizontal plane.

Figure 10:
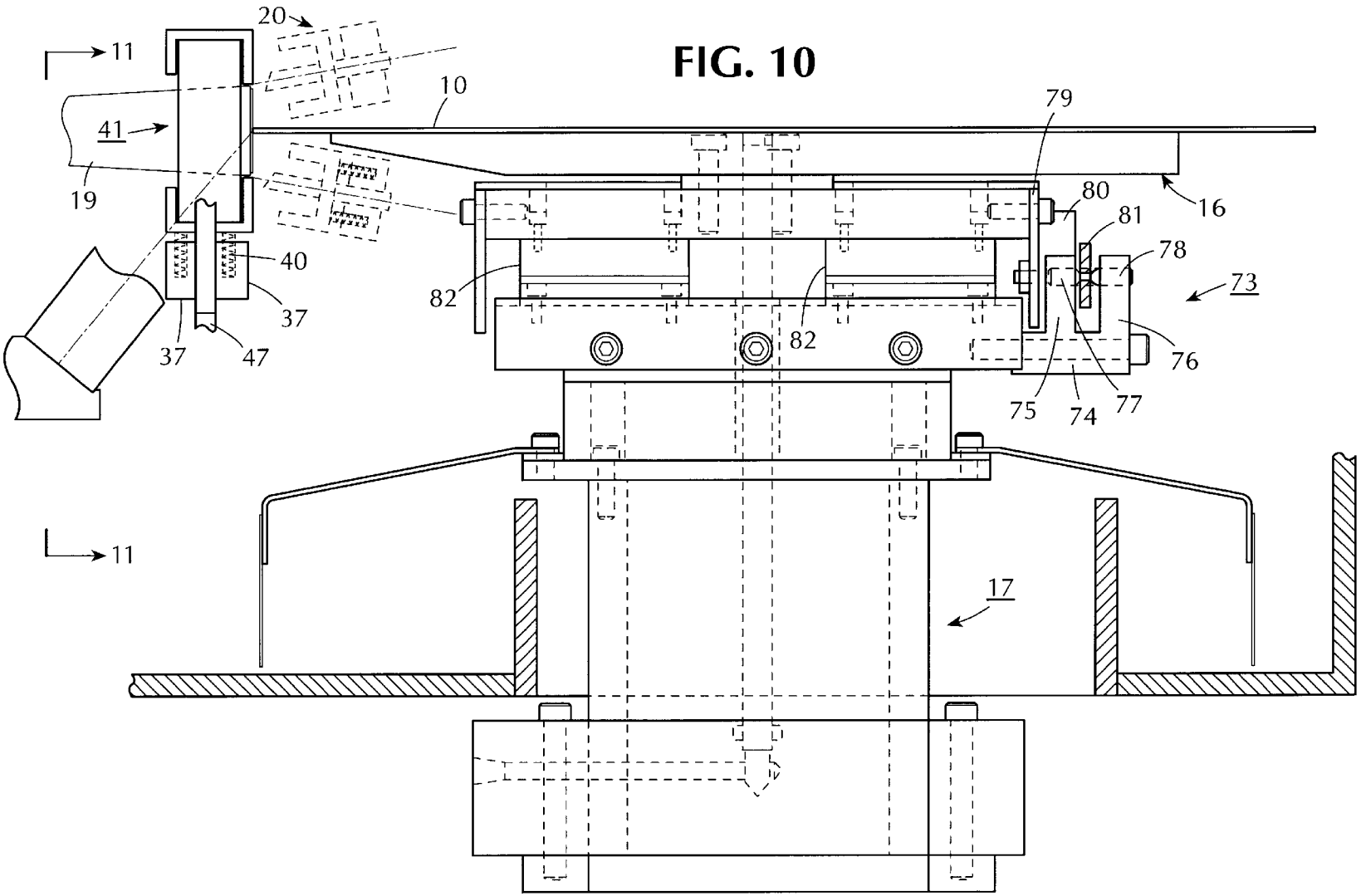
FIG. 10 illustrates a cross-sectional view of a chuck for holding a wafer in position during a polishing operation.

Referring to FIG. 10, the machine 15 also has a means 17 for moving the chuck 16 in two mutually perpendicular directions in a common plane, i.e. the horizontal plane as viewed. This means 17 will be further described below.

As shown in FIG. 6, the machine 15 also employs a polishing unit 18 for moving a selected one of a plurality of polishing media 19 (e.g., four) into the notch 11 of the wafer 10, for example, as shown in FIG. 1, along an axis perpendicular to the plane of the wafer 10 and, as shown in FIGS. 2 and 3, angularly within a plane perpendicular to the plane of the wafer 10.

The polishing unit 18 includes a mounting arrangement 20 for the polishing tapes 19 and a tape supply and removal means 21 for supplying the tapes 19 to the mounting arrangement 20.

Figure 8:
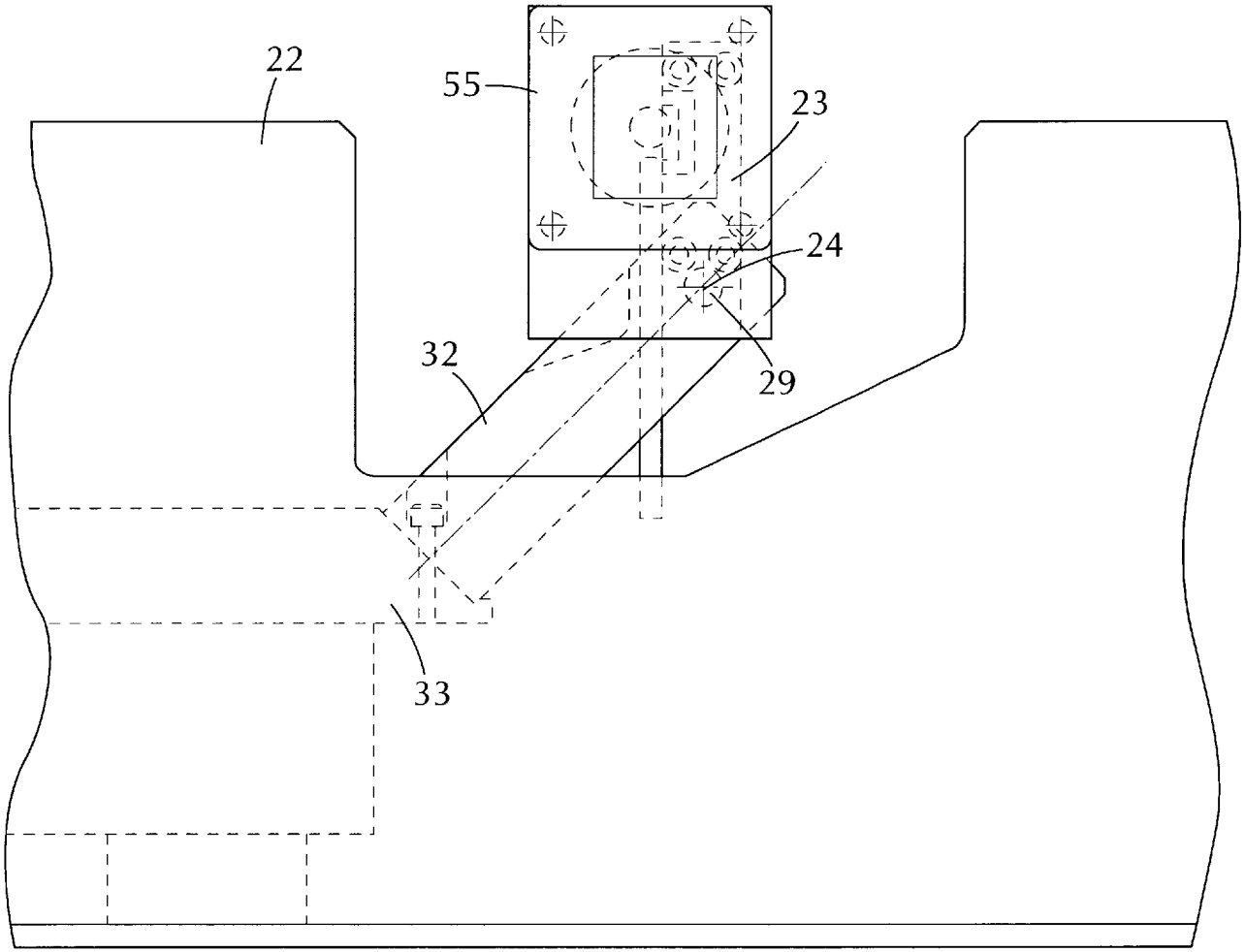
FIG. 8 illustrates a view taken on line 8—8 of FIG. 7.
Figure 11:
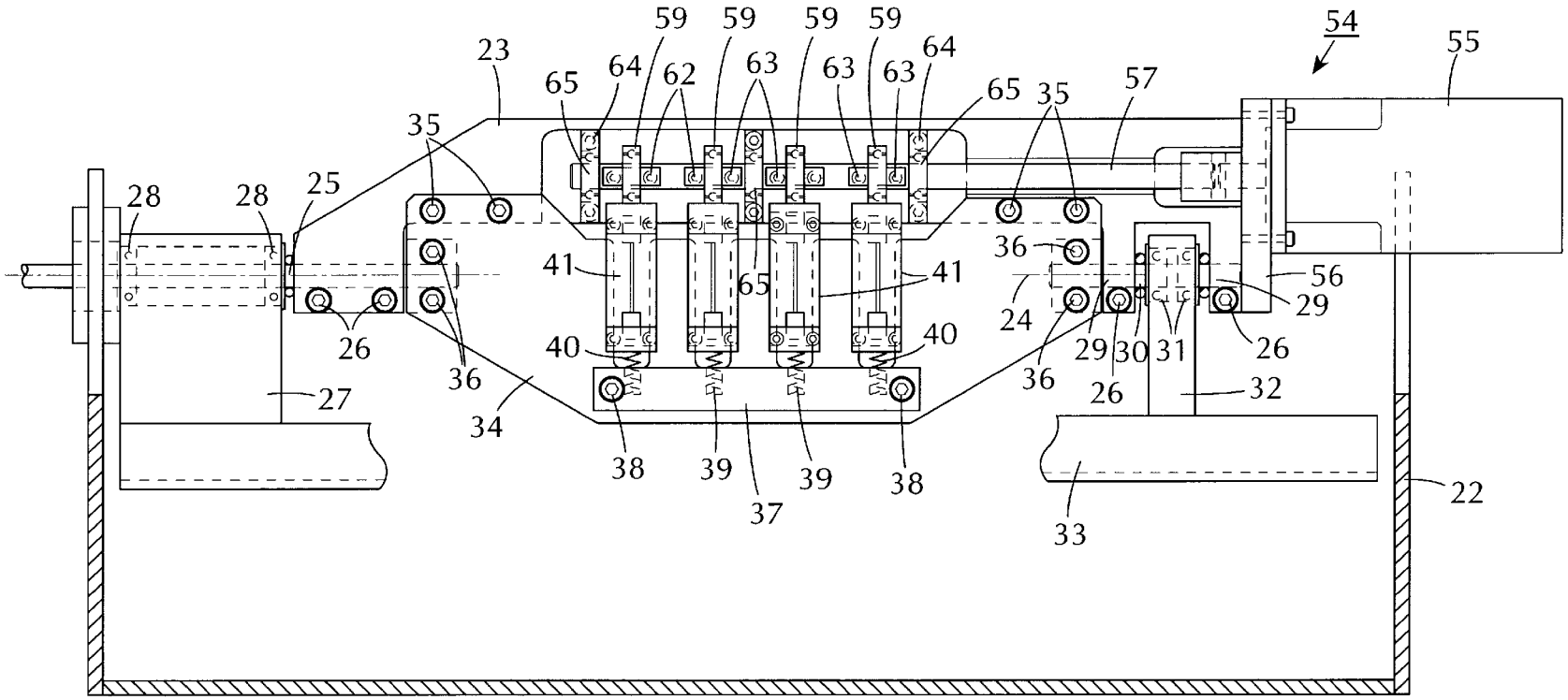
FIG. 11 illustrates a rear view of a mounting arrangement for the tape holding blocks of the polishing unit.

As indicated in FIGS. 6 and 11, the mounting arrangement 20 is mounted on a tub 22 in which the chuck 16 for holding the wafer 10 is also mounted. The mounting arrangement 20 includes a main piece 23 which extends across and within the tub 22 and is mounted on opposite ends for pivoting about a horizontal axis 24 (see FIGS. 8 and 11).

As shown in FIG. 11, one end of the main piece 23 is bifurcated and clamped over a pivot shaft 25 by bolts 26 for pivoting therewith. The shaft 25 passes through a bearing support 27 in which the shaft 25 is rotatably mounted via ball bearings 28 or the like. The shaft 25 is coupled to a pivot drive assembly (not shown) so that the shaft may be oscillated back and forth in a programmed manner by a suitable computer drive (not shown). The opposite end of the main piece 23 has a pair of legs 29 each of which is bifurcated and clamped by bolts 26 to a pivot shaft or pin 30, which is rotatably mounted via suitable bearings 31 in a second bearing support 32.

The two bearing supports 27, 32 which pivotally support the main piece 23 are secured in suitable fashion to a main support 33 which extends across the tub 22 and is fixed in a stationary manner to the base of a tub 22 in a manner not shown.

Referring to FIG. 11, a guide plate 34 is secured by a plurality of bolts 35 to the underside of the main piece 23 and is also coupled to the respective pivot shafts 25, 30 by a bifurcated section and clamping screws 36. The guide plate 34 carries a pair of bars 37, one on each side, which are secured thereto via suitable bolts 38 . Each bar 37 includes a plurality of recesses 39 in the upper surface, each of which receive a spring 40 for purposes as described below.

Figure 14:
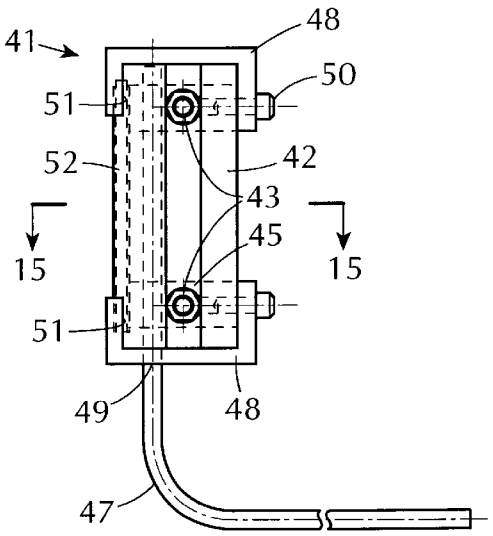
FIG. 14 illustrates a side view of an arrangement for mounting a polishing tape in a block in accordance with the invention.
Figure 15:
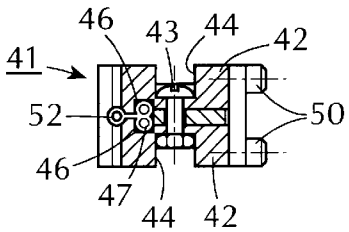
FIG. 15 illustrates a view taken on line 15—15 of FIG. 14.
Figure 12:
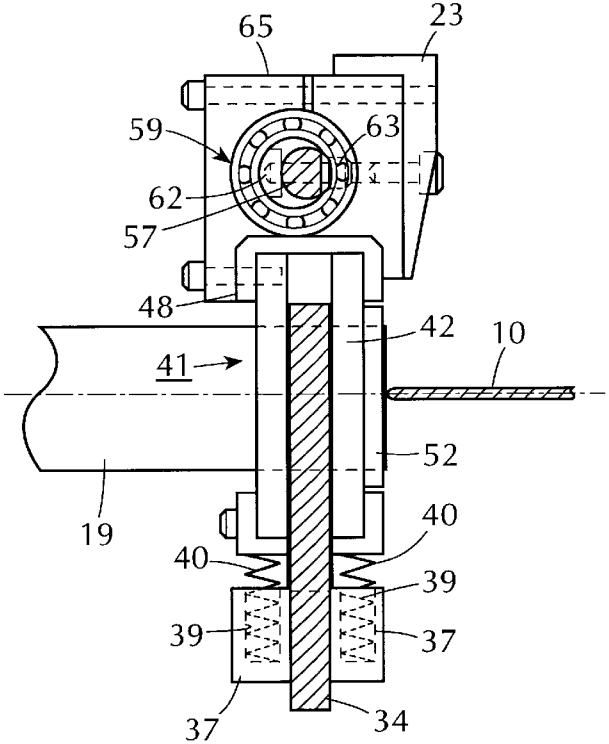
FIG. 12 illustrates a part cross-sectional side view of a means for oscillating a polishing tape.

The guide plate 34 has four vertical slots within an intermediate area for receiving four blocks 41 in a vertically slidable manner. Referring to FIGS. 14 and 15, each block 41 is formed of two substantially U-shaped half-blocks 42 which are secured in back-to-back fashion by a pair of clamping screws 43. Each half-block 42 has a rectangular recess 44 on the outside to receive the guide plate 34 as indicated in FIG. 12.

As indicated in FIGS. 14 and 15, a pair of keys 45 are provided in slots at the top and bottom of each half-block 42 for keying the half blocks 42 together and for guiding a polishing tape 19 therebetween. Each half-block 42 also includes a recess 46 facing the other half-block 42 in order to receive a length of an elastomeric pneumatic tube 47 which is folded over on itself and which is connected to a suitable source of air pressure or the like (not shown). As indicated in FIG. 14, the pneumatic tube 47 extends to near the top of the block 41 before being folded over on itself to extend downwardly. The terminal end of the tube 47 is sealed in any suitable fashion, for example, by means of a plug (not shown).

Each block 41 also has a pair of end-caps 48, one of which envelopes the tops of the half-blocks 42 and the other of which envelopes the bottoms of the half-blocks 42. As indicated in FIG. 14, the lower end-cap 48 is provided with a slot 49 through which the elastomeric pneumatic tube 47 passes. Each end-cap 48 is secured as by a pair of screws 50 to the respective half-blocks 42, as indicated in FIG. 15. Each end-cap 48 is also provided with a notch 51 on an inside wall for receiving a soft resilient tube 52. Typically, the tube 52, or an equivalent roller, is mounted to be freely rollable within the notches 51 of the end-caps 48.

Each block 42 is constructed so that a polishing tape 19 is looped over the outside of the soft resilient tube 52 with the two ends of the tape 19 disposed between the two lengths of pneumatic tubing 47 and between the two half-blocks 42. The mounting is such that the tape 19 may be readily pulled in either direction so as to dispose a fresh section of polishing tape 19 over the soft resilient tube 52. However, upon inflation of the elastomeric pneumatic tubing 47 under an internal pressure, as from a source of pressure, the two ends of the polishing tape 19 are clamped between the two sections of tubing 47 so that further motion of the tape 19 is not permitted.

Figure 7:
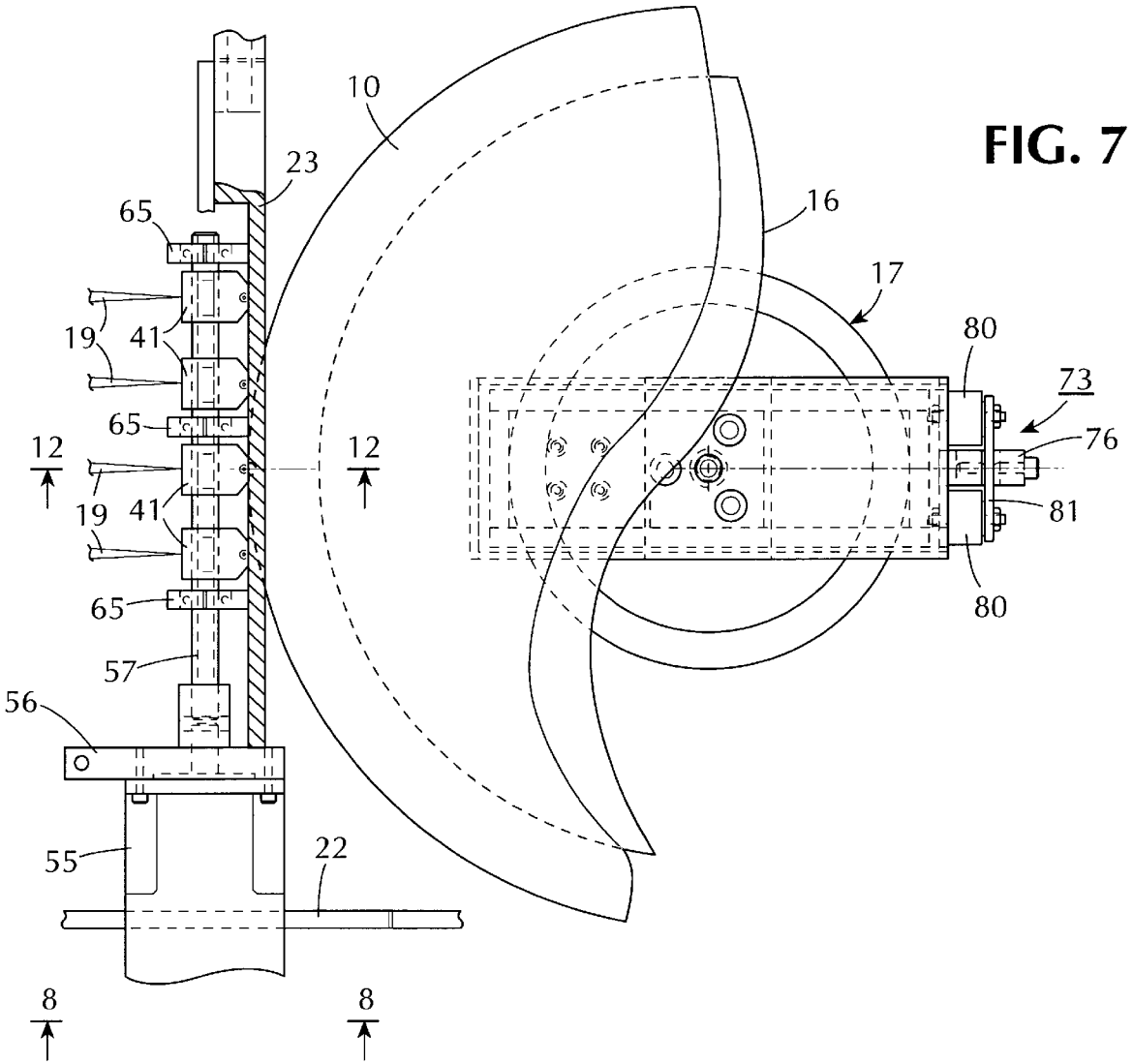
FIG. 7 illustrates an enlarged plan view of a row of blocks of a polishing unit used for mounting the polishing tapes in the machine of FIG. 6.

As schematically illustrated in FIGS. 7 and 12, the soft resilient tube 52 in a block 41 is positioned to move into the notch 11 of the wafer 10 when the wafer 10 is brought into position for polishing of the notch 11.

Figure 13:
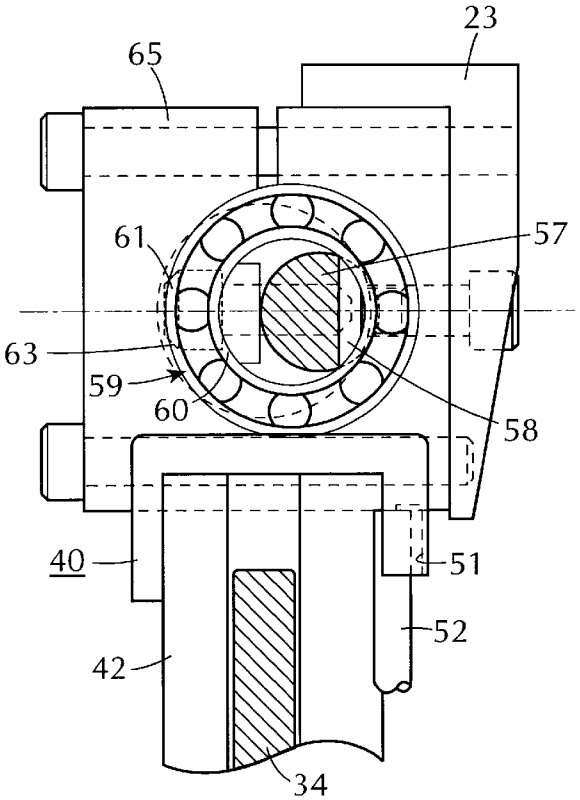
FIG. 13 illustrates an enlarged view of the oscillating means of FIG. 12.

Referring to FIGS. 11, 12 and 13, the polishing unit 18 is also provided with a means 54 for oscillating the blocks 41 during a polishing operation.

As shown in FIG. 11, the means 54 for oscillating the blocks 41 includes a motor 55 which is mounted via a mounting block 56 on the main piece 23 via suitable screws. In this way, the motor 55 moves with the main piece 23 during pivoting of the main piece 23. The motor 55 includes a cam shaft 57 which extends through the main piece 23 over the positions of the four blocks 41. This cam shaft 57 is provided with recesses 58 (see FIG. 13) coincident with the positions of the blocks 41. In addition, each consecutive recess 58 is disposed on an opposite side of the cam shaft 57 from the next. That is to say, the cam shaft 57 has a pair of recesses 58 on one side and a pair of recesses 180° apart on the opposite side. Each recess 58, as indicated in FIG. 13, receives a ball bearing 59 and, particularly, the inner race ring 60 of the ball bearing 59. The outer race ring 61 of each bearing 59 is disposed in contact with the upper end-cap 48 of a respective block 41.

As indicated in FIGS. 11, 12 and 13, an elongated key 62 is disposed within the inner race ring 60 of each bearing 59 and is secured to the cam shaft 57 by a pair of lock screws 63. The key 62 and screws 63 serve to lock the bearing 59 to the cam shaft 57 in an offset or eccentric manner. Thus, as the cam shaft 57 rotates, the inner race 60 ring of the bearing 59 rotates with the cam shaft 57 in an eccentric manner about the axis of the cam shaft 57. As a result, the bearing 59 causes the block 41 with which the bearing 59 is in contact to move down within the guide plate 34 against the biasing force of the springs 40 which bear against the lower end-cap 48 of the block 41 as well as allowing the block 41 to move up within the guide plate 34 under the force of the springs 40 in an oscillating manner.

As shown in FIG. 11, the cam shaft 57 is rotatably mounted within bearings 64 which are held in mounting blocks 65 secured to the main piece 23.

Upon actuation of the motor 55, the cam shaft 57 rotates causing the four bearings 59 to act as cams to move the blocks 41 up and down within the guide plate 23. The arrangement of the bearings 59 is such that two blocks 41 are moved downwardly while two other blocks are moved upwardly via the resilient mounting afforded by the springs 40.

Referring to FIG. 12, each resilient tube 52 of a block 41 serves as a rounded nose surface to fit within the notch 11 of the wafer 10. Further, the resiliency of the tube 52 allows for small deviations in pressure during contact between the wafer 10 and the polishing tape 19. To this end, the resilient tube 52 is of a radius which is less than the radius of the notch 11.

Referring to FIG. 10, the mounting arrangement 20 is pivotal on the axis of the pivot shafts 25, 30 (see FIGS. 8 and 11) so as to move between a first position, as shown in dotted line, with a block 41 disposed angularly of the top surface of the wafer 10 and a second position, also as shown in dotted line, with the block 41 disposed angularly of the opposite bottom surface of the wafer 10. Typically, each end position of a block 41 defines an included angle of 10° with the plane of the wafer 10.

Referring to FIG. 6, the means 21 for delivering the polishing tapes 19 to the respective blocks 41 includes a plurality of supply reels 66, i.e., four reels, for supplying the polishing tapes 19 to the respective blocks 41 and four take-up reels 67. As indicated, the four supply reels 66 are mounted on a common axis which is parallel to the plane of the wafer. Likewise, the four take-up reels 67 are mounted on a common axis parallel to the plane of the wafer 10. Thus, each tape 19 is initially played off a supply reel 66 in a horizontal plane and is then twisted into a vertical plane for passage through a respective block 41. Likewise, each tape 19 is again twisted into a horizontal plane when fed back to a take-up reel 67.

Figure 9:
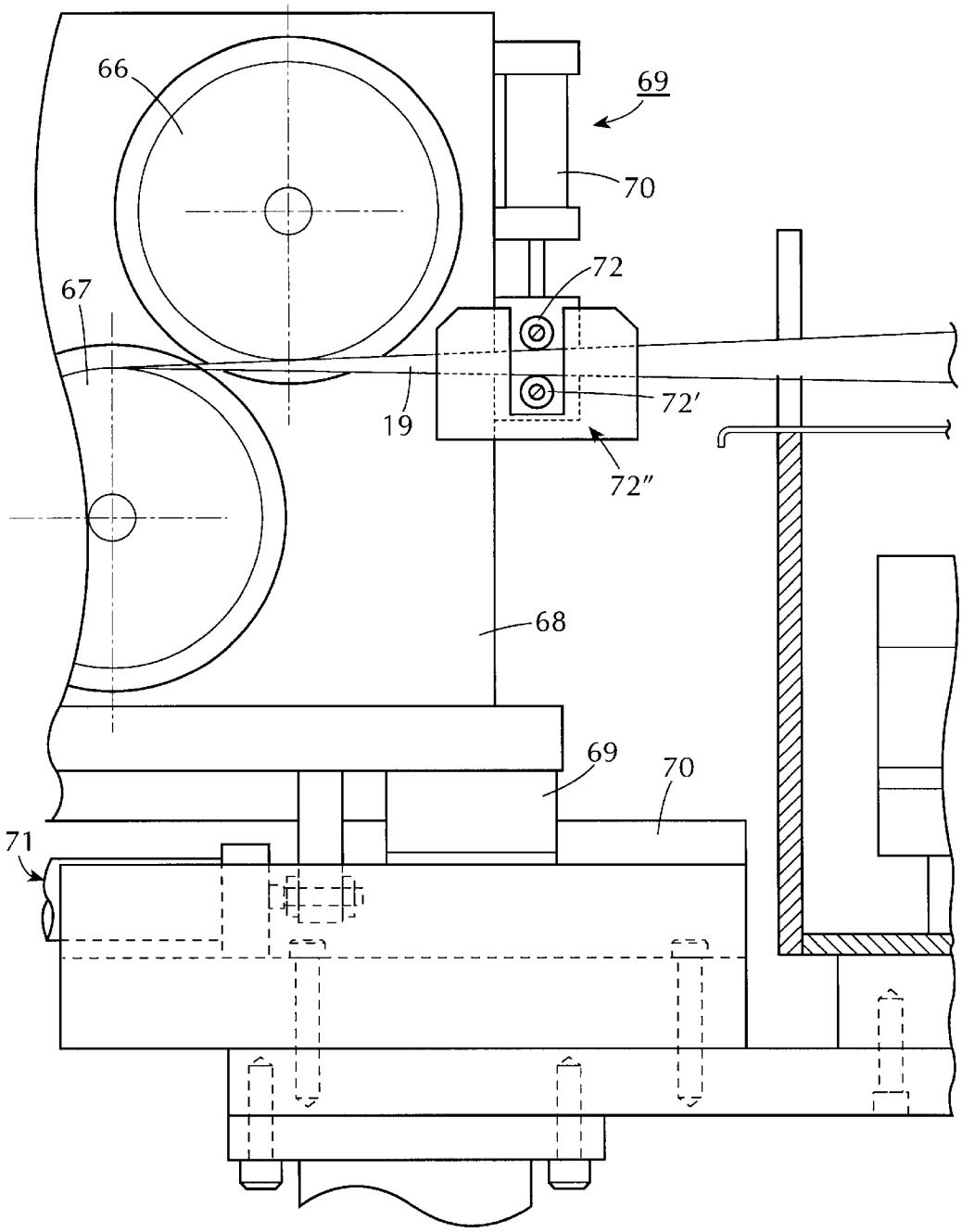
FIG. 9 illustrates a side view of a means for supplying and taking up a polishing tape for a block of a polishing unit in accordance with the invention.

Referring to FIG. 9, the supply reels 66 and take-up reels 67 are mounted on a common carriage 68 which, in turn, is mounted on a slide bearing 69 to move along bearing rails 70 for movement in a horizontal plane towards and away from the tub 22. Movement of the carriage 68 is effected via a pneumatic cylinder actuator arrangement 71.

The purpose of the movement of the carriage 68 from a fixed "home" position is to accommodate and provide the slack necessary in the tapes 19 to allow movement of the blocks 41 between the angular polishing positions relative to the top and bottom surfaces of a wafer 10 being polished. That is to say, as a block 41 is moved from a position perpendicular to the plane of the wafer 10 to an angular position relative to the plane of the wafer 10, the carriage 68 is moved to advance from the "home" position towards the tub 22 to prevent stretching of the tapes 19. Conversely, as a block is moved back to the "home" position perpendicular to the plane of the wafer, the carriage 68 moves backwardly away from the tub 22.

The carriage 68 is held in the fixed "home" position while the block 41 is positioned stationary and perpendicular to the plane of the wafer 10 when a fresh section of polishing tape from the tape supply reel 66 is fed to a block 41. Should there be slack in the tapes, the carriage 68 would be moved in a direction away from the tub 22 to take up the slack in the tapes and assure uniform positioning of the fresh section of each tape.

As also shown in FIG. 9, a tape containment and locking mechanism 69' is mounted on the carriage 68 in order to contain and hold the lengths of tape 19 in proper position relative to the reels 66 at times when the tapes are slackened. As illustrated, the locking mechanism 69' employs a pneumatic cylinder actuator 70' which moves a set of four rollers 72 into contact with a like set of stationary rollers 72' so that a tape 19 is firmly held between each pair of rollers 72, 72'. In addition, a plurality of fixed partitions 72" are positioned between the tapes 19 and along the outer edge of the outbound tapes to contain the tapes 19 laterally, i.e. the rollers 72,72' contain and clamp the tapes 19 vertically while the partitions 72" keep the tapes 19 separated and aligned horizontally. In this way, the containment and locking mechanism 69' serves to prevent a tape 19 from being inadvertently pulled off a supply reel 66 or slipping out of position relative to the reels 66 when the tapes 19 are slackened.

The containment and locking mechanism 69' is actuated after the tapes 19 have been locked in the blocks 41 via the pneumatic tubes 47 and prior to moving the carriage 68 to slacken the tapes 19.

Referring to FIG. 10, the chuck 16 is constructed in a suitable manner so as to hold a wafer 10 in place under vacuum. In addition, the chuck 16 is mounted to move via the means 17 in two directions in the plane of the wafer 10, for example, in an X direction towards a block 41 of the polishing unit 18 and a Y direction perpendicular to the X direction. Movement of the chuck 16 is controlled by a suitable central processing unit and is coordinated with the movements of a polishing block 41 so as to carry out a polishing operation.

The chuck 16 is also provided with a sensing means 73 to sense the point at which a wafer 10 is first brought into contact with a polishing tape 19 on a block 41. In this regard, the sensing means 73 is mounted on the chuck 16 at a point opposite a point at which the wafer 10 contacts the polishing unit 18 to sense an increase in resistance to further movement of the chuck 16 towards the polishing unit 18.

As illustrated, the sensing means 73 includes a bracket 74 which is secured to the means 17 for moving the chuck 16 on a side opposite the polishing unit 18. This bracket 74 is bifurcated to form two legs 75, 76, each of which has a set screw 77, 78 threaded therein in facing relation. A mounting plate 79 is also secured to the chuck 16 and carries a pair of load cells 80 thereon. Each load cell 80 is positioned to an opposite side of the bracket 74 (see FIG. 7). In addition, a strike bar 81 is secured to and connects the pair of load cells 80 and passes between the two legs 75, 76 of the bracket 74. In use, the internally disposed set screw 77 is permanently located in place while the exposed set screw 78 is used to lightly clamp the strike bar 81 between the set screws 77,78.

The chuck 16 is mounted to the x-y moving means 17 via linear roller slide bearings 82. This assures maximum support of the chuck 16 with minimal frictional influence from the bearings on the contact force as detected by the load cells 80.

When the means 17 moves the chuck 16 to move a wafer 10 against a polishing tape 19 on a block 41, the adjustable set screw 78 biases the against the strike bar 81. When the wafer 10 contacts the polishing tape 19, the contact force is routed back through the load cells 80 which, in turn, emit a corresponding signal to the central processing unit.

Sensing the contact of the wafer 10 against the tape 19 is important not only for controlling the tape pressure to optimize the polishing operation but also as a preliminary calibration tool to locate the centerline positions of the four blocks 41 relative to the "home" positions of the means 17 for the x-y movements of the chuck 16. This calibration would necessarily be done any time the blocks 41 are replaced or repaired for maintenance, at the very least. Calibration may also be required to center the notch 11 on the first block 41 with each wafer processed.

The central processing unit of the machine 15 serves to control and coordinate the motions of the carriage 68 for the tape delivering means 21, the chuck 16 holding the wafer 10 and the pivot drive assembly for pivoting the blocks 41 about the wafer 10. This central processing unit may also control the motor 55 for rotating the cam shaft 57 which oscillates the blocks 41 within the guide plate 34.

In operation, the polishing unit 18 is first set up with the polishing tapes 19 positioned in the blocks 41 ready for a polishing operation to commence. A wafer 10 is then placed on the chuck 16 automatically by a suitable delivery device or by hand and then the chuck 16 is moved towards the polishing unit 18 (FIG. 6). Typically, the wafer 10 is moved towards the polishing unit 18 to position the notch 11 of the wafer 10 against the first polishing block 41 of the polishing unit 18.

As the wafer 10 comes into contact with a tape 19 on the first polishing block 41, the sensing means 73 (FIG. 10) senses the contact and emits a corresponding signal to the central processing unit (not shown). Depending on the signal the chuck 16 may be stopped or moved towards or away from the wafer lO in order to position the wafer 10 relative to the tape 19 under the desired contact force for a polishing operation. At the time that the wafer 10 abuts a tape 19, the resilient tube 52 behind the tape 19 absorbs any shock.

Thereafter, the central processing unit (not shown) effects an oscillating movement of the block 41 in contact with the wafer 10 to begin a polishing operation. In addition, the central processing unit effects small movements of the wafer 10 in each of the x and y directions relative to the block 41 so that the tape 19 is able to polish the contour of the notch 11 in the wafer 10 (FIG. 4).

The central processing unit also effects a pivoting movement of the block 41, for example, into the upper dotted line position shown in FIG. 10. During this motion, the block 41 continues to oscillate under the influence of the cam shaft 57 so that the upper surface of the notch 11 of the wafer is polished. Again, the wafer 10 may be moved in small x and y directions relative to the block 41 to enhance the polishing operation.In addition, the carriage 68 is moved toward the tub 22 and the polishing unit 18 to avoid stretching of the polishing tapes 19.

The block 41 is then pivoted into the lower dotted line position shown in FIG. 10 to complete the polishing operation. At this time the carriage 68 is moved away from the polishing unit 18 to avoid slack from being introduced in the tapes 19 and then moved toward the polishing unit 18 as the block 41 pivots below the plane of the wafer 10.

Thereafter, the chuck 16 is moved away from the polishing unit 18 and indexed to align the notch 11 of the wafer 10 with the next block 41 (FIG. 6). Similar motions of the machine components are then repeated to perform another polishing operation but with the different size grit of the second polishing tape 19. Indexing of the wafer 10 is repeated until the desired polishing effect has been obtained. The chuck 16 is then moved away from the polishing unit 18 and the wafer 10 moved to another processing operation.

Thereafter, if the sections of the tapes 19 are not reuseable, fresh sections of the tapes 19 are moved into the blocks 41. At this time, the locking mechanism 69' (FIG. 9) is actuated to release the tapes 19 so that the tapes 19 may be incremented off the supply rolls 66 an amount sufficient to present fresh surfaces. Next, the compressed air supply to the pneumatic tube 47 of each block 41 is terminated to unclamp the tape 19 therein (FIG. 15). The take-up reels 67 are then indexed via a suitable motor (not shown) by the central processing unit for each to take-up a determined amount of tape 19. During this time each tape 19 slides through a respective block 41 to present a fresh polishing surface over the resilient tube 52. Thereafter, the pneumatic tubes 47 are again inflated to clamp the tapes 19 in place and the locking mechanism 69' actuated to again clamp the tapes 19.

The invention thus provides a relative simple machine which can be used to polish the notch in a wafer in an economic manner. Further, the invention provides a machine which can be used in a stand-alone manner to polish a notch in a wafer or which can be incorporated into a more complex machine for polishing the entire periphery of a wafer.

The machine may also be adapted for other types of uses than polishing a notch in a wafer. For example, the machine may be used to polish the entire periphery of a wafer or the machine may be used to remove a bead of material from a peripheral edge of a wafer. For example where a wafer has been processed and has one of more layers of material thereon, the edge of such a wafer may be placed in the machine so that any bead of material at the edge of the wafer may be ground off.

Also, the machine may be used to grind or polish two opposite surfaces at the edge of any substrate due to the ability to pivot the polishing tapes from one side of a substrate to the opposite side while the tapes are oscillated.

In a similar sense, depending on the shape of the substrate, a plurality of tapes may be brought into contact with the substrate rather than only one tape. For example, where the substrate has a straight or contoured edge two or more tapes may be brought into contact with the edge to effect a polishing or grinding operation.

What is claimed is:

1. A wafer notch polishing machine comprising a chuck for holding a wafer having a peripheral notch thereon;

means for moving said chuck in two mutually perpendicular directions in a common plane;

a polishing unit for moving a polishing medium within the notch along an axis perpendicular to said common plane and angularly within a plane perpendicular to said common plane.

2. A wafer notch polishing machine as set forth in claim 1 wherein said common plane is a horizontal plane.

3. A wafer notch polishing machine as set forth in claim 1 wherein said polishing unit includes at least one block having a rounded nose surface with said polishing medium thereon for fitting into a notch of a wafer held on said chuck; and means for pivoting said block about an axis parallel to said common plane between a first position with said block disposed angularly of one surface of a wafer on said chuck and a second position with said block disposed angularly of an opposite surface of the wafer on said chuck.

4. A wafer notch polishing machine as set forth in claim 3 wherein each said position of said block defines an included angle of 10° with said common plane.

5. A wafer notch polishing machine as set forth in claim 3 wherein said polishing unit further comprises means for oscillating said block longitudinally thereof during pivoting of said block between said positions.

6. A wafer notch polishing machine as set forth in claim 3 wherein said rounded nose surface has a forward portion on a radius less than a radiused portion of a notch in a wafer on said chuck.

7. A wafer notch polishing machine as set forth in claim 3 wherein said polishing unit further comprises a plurality of said blocks disposed in spaced-apart parallel relation.

8. A wafer notch polishing machine as set forth in claim 3 wherein said polishing medium is a polishing tape disposed on said rounded nose surface.

9. A wafer notch polishing machine as set forth in claim 8 wherein said polishing unit further comprises means for delivering said polishing tape to said block.

10. A wafer notch polishing machine as set forth in claim 9 wherein said means for delivering a polishing tape includes a supply reel disposed on an axis parallel to said common plane for feeding the polishing tape to said block, and a take-up reel disposed on an axis parallel to said common plane for winding-up of the polishing tape from said block.

11. A wafer notch polishing machine as set forth in claim 10 which further comprises a clamping means between said reels and said block for clamping said tape thereat.

12. A machine comprising at least one block having a nose surface for receiving a polishing medium thereon for polishing an edge of a workpiece;

means for pivoting said block about a plane of the workpiece between a first position with said block disposed angularly of said plane on one side of the workpiece and a second position with said block disposed angularly of said plane on an opposite side of the workpiece; and means for oscillating said block longitudinally thereof during pivoting of said block between said positions.

13. A machine as set forth in claim 12 wherein said means for pivoting said block includes a main piece disposed for pivoting about a fixed axis and having said block slidably mounted thereon for movement longitudinally thereof.

14. A machine as set forth in claim 13 wherein said means for oscillating said block includes at least one spring disposed between said block and said main piece, a rotatable cam shaft parallel to and mounted on said main piece and a cam on said cam shaft in contact with said block on a side opposite said spring.

15. A machine as set forth in claim 14 wherein said means for oscillating said block further includes a motor mounted on said main piece and drivingly connected to said cam shaft for rotating said cam shaft.

16. A machine as set forth in claim 13 having a plurality of said blocks mounted on said main piece.

17. A machine as set forth in claim 12 wherein said block includes a pair of half blocks for guiding a folded over polishing tape having the polishing medium thereon therebetween and a tube rotatably disposed between said half blocks for looping of the polishing tape thereover.

18. A machine as set forth in claim 17 wherein said tube is resilient.

19. A machine as set forth in claim 17 which further comprises an elastomeric pneumatic tube disposed in folded over relation between said half blocks for passage of the folded over tape therebetween, said pneumatic tube being inflatable to clamp the tape therebetween.

20. method of polishing an orientation notch in a wafer, said method comprising the steps of holding a wafer having a peripheral notch therein on a fixed plane;

moving the wafer in two mutually perpendicular directions in said plane;

moving a polishing medium within the notch along an axis perpendicular to said fixed plane and angularly within a plane perpendicular to said fixed plane during movement of the wafer in said fixed plane.

21. A method as set forth in claim 20 which further comprises the step of pivoting the polishing medium about an axis parallel to said fixed plane between a first position with the polishing medium disposed angularly of one surface of the wafer and a second position with the polishing medium disposed angularly of an opposite surface of the wafer.

22. A method as set forth in claim 21 wherein each said position defines an included angle of 10° with said fixed plane.

23. A method as set forth in claim 21 which further comprises the step of oscillating the polishing medium longitudinally thereof during pivoting between said positions.

* * * * *